US005813891A

United States Patent [19]

McNamee

[11] Patent Number: 5,813,891

[45] Date of Patent: *Sep. 29, 1998

[54] LIFE-SAVING AID

[75] Inventor: John Boden McNamee, Kellyville, Australia

[73] Assignee: Flube Pty. Ltd., Australia

[ * ] Notice: This patent issued on a continued prosecution application filed under 37 CFR 1.53(d), and is subject to the twenty year patent term provisions of 35 U.S.C. 154(a)(2).

[21] Appl. No.: 737,776

[22] PCT Filed: May 29, 1995

[86] PCT No.: PCT/AU95/00309

§ 371 Date: Nov. 25, 1996

§ 102(e) Date: Nov. 25, 1996

[87] PCT Pub. No.: WO95/32890

PCT Pub. Date: Dec. 7, 1995

[30] Foreign Application Priority Data

May 27, 1994 [AU] Australia ..... PM 5911

[51] Int. Cl.[6] ..... B63C 9/08

[52] U.S. Cl. ..... 441/108; 441/88

[58] Field of Search ..... 441/80, 88, 89, 441/90, 92–102, 108, 106, 113, 123, 125, 84

[56] References Cited

U.S. PATENT DOCUMENTS

| | | | |
|---|---|---|---|
| 1,493,664 | 5/1924 | Blum | 441/113 |
| 2,368,558 | 1/1945 | Maloney | 441/198 |
| 3,127,624 | 4/1964 | Kubit et al. | 441/95 |
| 4,184,216 | 1/1980 | Saleen | 441/93 |
| 5,348,504 | 9/1994 | Pierce et al. | 441/113 |

FOREIGN PATENT DOCUMENTS

| | | | |
|---|---|---|---|
| 2105411 | 4/1972 | France | 441/84 |

*Primary Examiner*—Ed L. Swineheart
*Attorney, Agent, or Firm*—Ostrolenk, Faber, Gerb & Soffen, LLP

[57] ABSTRACT

A life-saving aid comprising an elongate inflatable tube provided with an automatic inflation device arranged to release $CO_2$ gas to inflate the tube when immersed in water or manually triggered. When inflated, the tube forms an elongate substantially linear cylinder sufficiently rigid to at least support its own weight when held horizontally from a proximal end. The tube is compact when deflated, is throwable, has significant tensile strength, and is designed so that after inflation and use, gas may be readily excluded via oral inflation tube by releasing the valve and rolling the tube from distal end toward proximal end.

7 Claims, 1 Drawing Sheet

LIFE-SAVING AID

TECHNICAL FIELD

This invention relates to a life-saving aid and has been devised particularly though not solely for personal use in an emergency water safety situation.

BACKGROUND ART

Many forms of inflatable life-saving aids or personal buoyancy aids have been provided in the past designed to support a person in the water to prevent drowning either in a predictable situation where the person is involved, for example in boating or other water sports, or in an emergency situation where a person unexpectedly falls into a body of water.

Full life jackets or personal flotation devices, while effective to support a person in the water, in some cases even where the person is unconscious, are generally bulky and uncomfortable to wear and because of this are not commonly available in an emergency use situation. Some flotation devices or personal buoyancy aids are of an inflatable nature in order to reduce their bulk when not actively in use, and are commonly provided with a source of compressed gas such as a $CO_2$ bottle able to be triggered either manually or automatically upon immersion in water to inflate the buoyancy aid. Such devices are generally in the form of jackets or horseshoe-type rings which are difficult to fold once deflated and particularly difficult to exclude gas from for re-packaging, once they have been inflated and used. There is therefore a marked reluctance on the part of owners of such devices to use the devices in a trial situation and the owners are therefore generally unfamiliar with the actual properties and use of the life-saving device, significantly reducing the effectiveness of the device in an emergency situation.

It is a further feature of known life jackets or personal flotation devices that they are difficult to share with a person in distress which therefore limits their use to a single person and renders it difficult for a rescuer to share the life-saving aid with the person in distress. It is also impossible to transfer an inflated life jacket or personal flotation device from one person to another without deflating the device.

It is also highly desirable to be able to provide an inflatable life-saving aid which is low in cost and extremely compact when deflated and so can be readily carried in the pocket or clipped, to e.g. to the belt of a user without inconvenience and yet which may be swiftly and promptly deployed in an emergency situation either for the use of the person carrying the life-saving aid or as a device to be thrown to another person in distress in the water.

DISCLOSURE OF INVENTION

The present invention therefore provides an inflatable life-saving aid comprising an elongate closed tube of flexible material having inflation and deflation means at or adjacent a proximal end of the tube, arranged such that gas can be readily excluded from the tube after inflation by opening the deflation means and rolling the tube into a roll from the distal end towards the proximal end.

Preferably the tube is linear, forming a cylinder when inflated.

Preferably the tube is provided with hand grips at both proximal and distal ends.

Preferably the hand grips are reinforced for example by use of a metal bar to enable the tube to carry a significant load applied at the point of the hand grips.

Preferably the ends of the tube are provided with securing means adapted to engage one another, forming the tube into a loop.

Preferably the inflation means comprise an automatic trigger mechanism and a source or compressed gas, actuable upon submersion into water to release the compressed gas into the tube.

Preferably the proximal end of the tube is attached to a safety line, wound on to a reel adapted to be held by a user when the aid is thrown to a desired location.

BRIEF DESCRIPTION OF DRAWINGS

Notwithstanding any other forms that may fall within its scope, one preferred form of the invention will now be described by way of example only with reference to the accompanying drawings, in which.

MODES FOR CARRYING OUT THE INVENTION

Figure 1:
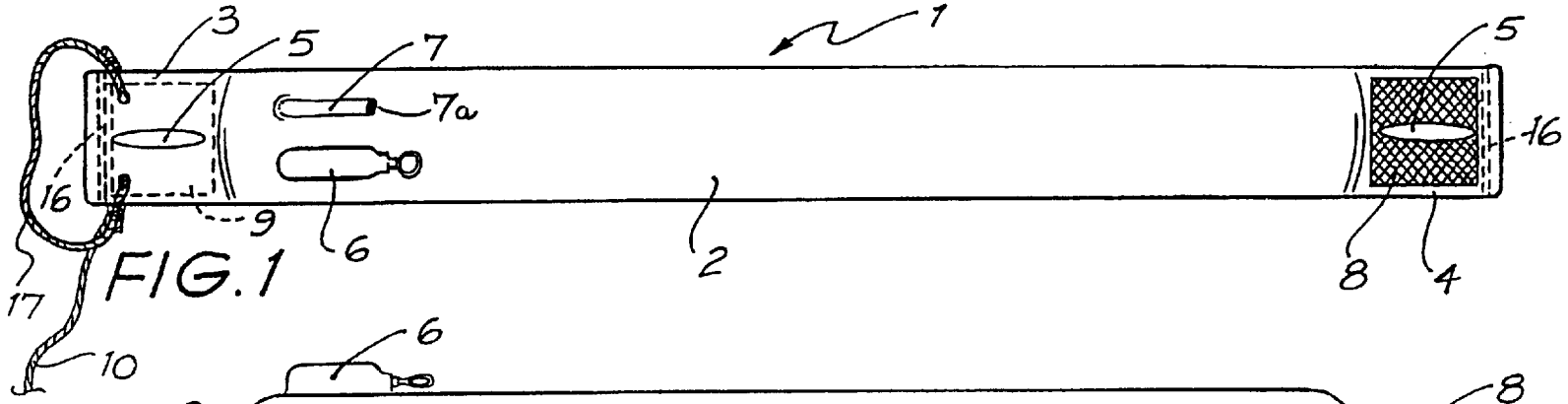
FIG. 1 is a diagrammatic plan view of an inflated life-saving aid according to the invention.

In the preferred form of the invention an inflatable life-saving aid 1 is provided in the form of an elongate tube 2 having a proximal end 3 and a distal end 4. Both ends are closed, for example by welding or gluing together the end portions of the tube to form flat portions 3 and 4. These flat portions are conveniently provided with hand holds 5 whose use will be described later.

The life-saving aid is provided with inflation means 6 in the form of a source of compressed gas, suck as a $CO_2$ bottle and a trigger mechanism adapted to release compressed gas from the bottle into the tube 2 upon manual actuation by a lever or lanyard, or by automatic operation. The automatic operation is typically achieved by the use of a soluble tablet within the trigger mechanism which dissolves on immersion in water, actuating the trigger mechanism to release gas from the bottle into the tube 2.

The life-saving aid is further provided with an oral inflation tube 7 typically incorporating a non-return valve 7*a* which is manually releasable to form deflation means allowing gas within the tube 2 to be expelled from the tube as will be described later.

The ends 3 and 4 of the tube are provided with securing means adapted to engage one another and form the tube into a loop. In the preferred form of the invention the securing means comprise a portion of loop material 8 of a hook and loop fastener material (such as that sold under the trademark VELCRO) attached to the distal end 4 and a portion of VELCRO® hook material 9 attached to the proximal end 3. In an alternative form of the invention (not shown) it is possible to provide either the hook or the loop portion of VELCRO® as an extended member allowing engagement of the other portion at different positions along the length of the extended member so adjusting the size of the loop formed with the inflatable tube 2.

The life-saving aid is also preferably provided with a safety line 10 which may conveniently be wound on to a reel 11 (FIG. 3) for use in throwing the life-saving aid. The reel 11 typically comprises a spool having a core 12 and end flanges 13 and 14, the end flange 14 being attached to a handle 15 to be conveniently grasped by the user. The safety line is wound on to the core 12 having one end fastened to the core and the other end fastened to the tube as shown in FIG. 1.

Figure 3:
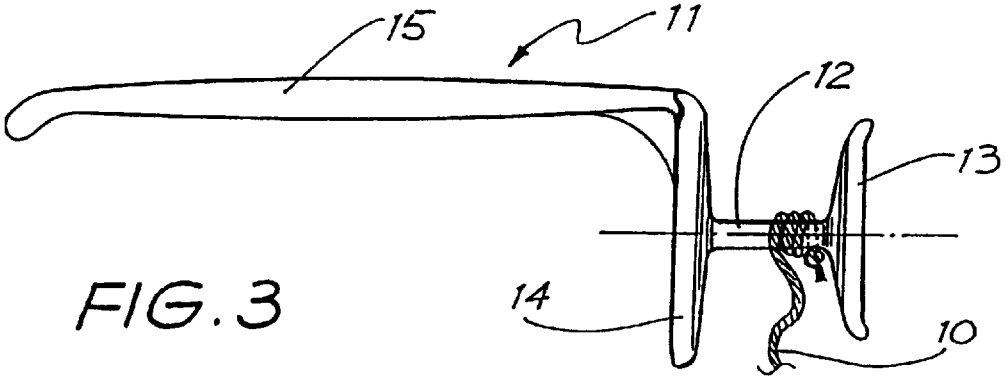
FIG. 3 is a side view of a safety line reel adapted to be used with the life-saving aid shown in FIGS. 1 and 2.

The handle 15 is offset as shown in FIG. 3 to enable the rolled up tube to be stored in a carrying pouch with the reel by packing the rolled up tube alongside the offset handle and in line with the spool portion of the handle. This configuration not only allows a compact packaging of the total life-saving aid but also enables the tube to be expelled cleanly from a carrying pouch when inflation is commenced.

Figure 2:
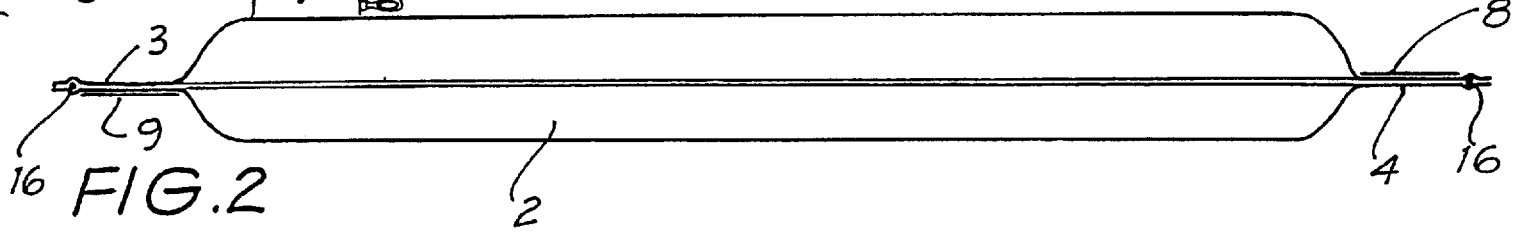
FIG. 2 is a side view of the aid shown in FIG. 1.

The life-saving aid is typically stored, ready for use by rolling the tube 2 into a roll from the distal end 4 towards the proximal end 3 so forming a very compact package that can readily be contained within a small pouch able to be carried in a pocket of the user or, for example clipped on to a belt or other item of clothing. When carried by a user in this manner, the device may be deployed by the user either by triggering the inflation means 6 or by automatic actuation due to submersion in water acting on the soluble tablet contained within the inflation means. Once gas is released from the $CO_2$ bottle, the tube 2 is inflated causing the tube to unroll and form an elongate cylinder as shown in FIGS. 1 and 2. The user can either grasp hold of the cylinder for support in the water, or alternatively can wrap the cylinder around his body, securing it in place by engaging the VELCRO® portions 8 and 9.

A rescuer can easily use the tube to assist a person in distress in the water, the elongate nature of the tube being an advantage in enabling the rescuer to avoid contact with the victim who may be in a state of panic.

Because the aid is very compact in its deflated and rolled-up form, it is also suitable for use in rescuing a third party in distress in the water. The entire rolled-up aid can be readily thrown when deflated, frequently in conjunction with the safety line 10. In this situation, the user holds the handle 15 in one hand while pointing the flange 13 in the direction it is intended to throw the life-saving aid. As the aid is thrown, the safety line unreels from the spool 12 in the manner of fishing line from a fishing spool enabling the user to throw the aid a considerable distance while yet retaining control and then being able to use the safety line to haul in a person in distress who has grasped hold of the tube. As the aid hits the water, the inflation means 6 is automatically actuated to inflate and unroll the tube 2 into the deployed configuration.

Due to the elongate cylindrical nature of the inflated aid it can be grasped vertically by a person in the water whose foot can be inserted into a loop 17 to support the weight of the person and hold the distal end upwardly in the air. This is particularly useful in man overboard situations where the distal end, typically brightly coloured, acts as a flag or marker pole improving the chances of spotting the person in the water. This can be enhanced by fitting a radio beacon or strobe light etc to the distal end if required.

It is a particular feature or the inflated aid, that it has an elongate cylinder having a handle at each end, that it is suitable for use as a life-saving aid due to its significant length and stiffness in non-floating situations, e.g. at the edge or a swimming pool, enabling a person at the edge of the pool to extend the aid across the pool to be grasped by a person in distress within the pool, without the user having to enter the pool himself. In a similar manner, the inflated aid can be extended down a cliff face or a well to assist in the rescue of a trapped person. Available data shows that a significant number of distress situations such as drownings occur within a few metres of safety. This figure may be as high as 95% and it is therefore a significant use of the life-saving aid according to the invention to be used as described above in rescuing a person in this situation.

To reinforce the hand or foot holds 5, a rigid or strong bar 16 such as a metal bar may be incorporated into the ends 3 and 4 beyond the hand holds 5.

It is a particular feature of the invention, that due to the elongate cylindrical configuration of the inflated tube 2, it is extremely easy and quick to exclude gas from the tube after use, by releasing the valve in the oral inflation means 7 which then becomes a deflation means, and rolling the tube from the distal end 4 toward the proximal end 3, excluding all gas from the tube and enabling it to be repacked into an extremely compact configuration. This is a distinct advantage over all known types of inflatable buoyancy aids from which it is difficult to exclude gas once inflated and to repack into a compact container. This difficulty inhibits the owners of such prior art devices from inflating their buoyancy aids to practice their use, so significantly reducing the effectiveness of the aid in an emergency situation.

Because the life-saving aid according to the invention is so easy to deploy, and to repack for reuse, experimental use is encouraged by the user enabling considerable practice of the aid as a life-saving device and therefore significantly enhancing its effectiveness.

The aid is also much cheaper and simpler to manufacture compared with existing jackets or horseshoetype aids. The straight elongate tube lends itself well to automated manufacturing techniques.

I claim:

1. An inflatable life-saving aid comprising:

an elongate closed tube of flexible material having inflation means at or adjacent a proximal end of the tube, the tube and inflation means being configured to form, when inflated, an elongate substantially linear cylinder sufficiently rigid to at least support its own weight when held horizontally from the proximal end; and hand grips provided at the proximal and distal ends of the tube, respectively, such that the life-saving aid can be held by the hand grip at the proximal end and extended to another for grasping of the hand grip at the distal end.

2. An inflatable life-saving aid as claimed in claim 1 wherein deflation means are provided adjacent the proximal end of the tube, and the tube and deflation means are arranged such that gas can be readily excluded from the tube after inflation by opening the deflation means and rolling the tube into a roll from the distal end towards the proximal end.

3. An inflatable life-saving aid as claimed in claim 1 wherein the ends of the tube are provided with securing means adapted to engage one another, forming the tube into a loop.

4. An inflatable life-saving aid as claimed in claim 2 wherein the inflation means include an oral inflation means and wherein the deflation means are incorporated in the oral inflation means by way of a releasable non-return valve.

5. An inflatable life-saving aid as claimed in claim 1 wherein the proximal end of the tube is attached to a safety line, wound on to a reel adapted to be held by a user when the aid is thrown to a desired location.

6. An inflatable life-saving aid as claimed in claim 7 wherein the reel has an axis for rotation to wind the safety line on the reel, and wherein the reel further comprises a handle for manually rotating the reel, the handle being offset from the rotational axis of the reel, the tube being storable in a deflated, rolled configuration alongside the offset handle and in line with the rotational axis of the reel.

7. An inflatable life-saving aid as claimed in claim 1, wherein the elongate closed tube extends from a proximal end to a distal end of the life-saving aid.

* * * * *